US008293102B2

(12) United States Patent
Mesher et al.

(10) Patent No.: US 8,293,102 B2
(45) Date of Patent: Oct. 23, 2012

(54) TREATMENT OF STIMULATING FLUID

(75) Inventors: Shaun Mesher, Calgary (CA); Robin Tudor, Calgary (CA); Jessie Leighton, Calgary (CA)

(73) Assignee: Synoil Fluids Holdings Inc., Calgary, Alberta (CA)

( * ) Notice: Subject to any disclaimer, the term of this patent is extended or adjusted under 35 U.S.C. 154(b) by 760 days.

(21) Appl. No.: 12/341,624

(22) Filed: Dec. 22, 2008

(65) Prior Publication Data

US 2009/0229825 A1 Sep. 17, 2009

Related U.S. Application Data

(60) Provisional application No. 61/018,135, filed on Dec. 31, 2007.

(51) Int. Cl.
*C02F 9/00* (2006.01)

(52) U.S. Cl. ..... 210/201; 210/181; 210/199; 210/202; 166/75.12

(58) Field of Classification Search ..... 210/181
See application file for complete search history.

(56) References Cited

U.S. PATENT DOCUMENTS

| | | | | |
|---|---|---|---|---|
| 4,247,312 | A * | 1/1981 | Thakur et al. | 96/159 |
| 4,716,932 | A | 1/1988 | Adams, Jr. | |
| 5,098,580 | A * | 3/1992 | Andersen | 210/745 |
| 5,312,551 | A * | 5/1994 | Perron et al. | 210/712 |
| 5,928,519 | A * | 7/1999 | Homan | 210/741 |
| 6,263,967 | B1 | 7/2001 | Morris et al. | |
| 7,144,516 | B2 * | 12/2006 | Smith | 210/803 |
| 7,527,726 | B2 * | 5/2009 | Slough et al. | 210/96.1 |
| 7,572,382 | B2 | 8/2009 | Mesher et al. | |
| 7,575,690 | B2 | 8/2009 | Mesher et al. | |
| 7,771,594 | B2 * | 8/2010 | Ralph et al. | 210/195.1 |
| 7,972,501 | B2 * | 7/2011 | Godlien | 210/96.1 |
| 2005/0173677 | A1 | 8/2005 | Mesher et al. | |
| 2006/0046939 | A1 | 3/2006 | Mesher | |
| 2010/0099584 | A1 | 4/2010 | Mesher et al. | |
| 2010/0132942 | A1 | 6/2010 | Edwards | |

FOREIGN PATENT DOCUMENTS

| | | |
|---|---|---|
| CA | 2426256 | 10/2004 |
| CA | 2435629 | 1/2005 |
| CA | 2550382 | 12/2007 |
| CA | 2566070 | 12/2007 |
| CA | 2636560 | 6/2009 |
| CA | 2683834 | 4/2010 |

* cited by examiner

*Primary Examiner* — Tony G Soohoo
*Assistant Examiner* — Peter Keyworth
(74) *Attorney, Agent, or Firm* — Bennett Jones LLP

(57) ABSTRACT

An apparatus and method for the treatment of stimulation fluid that involves passing a mixture of the stimulation fluid and reagents through a sectioned tank, each section having the means to agitate the mixture contained therein. Treated fluid is removed from a final settling section for reuse in oil and gas production operations.

11 Claims, 6 Drawing Sheets

TREATMENT OF STIMULATING FLUID

CROSS-REFERENCE TO RELATED APPLICATION

This application claims the priority benefit of U.S. Provisional Patent Application No. 61/018,135, filed on Dec. 31, 2007, the entire contents of which are incorporated herein by reference.

FIELD OF THE INVENTION

The invention relates to an apparatus and method for use in the treatment of a stimulation fluid, and of a hydrocarbon-based stimulation fluid in particular.

BACKGROUND

Stimulation fluids are used in the oil and gas industry to create additional permeability in oil and gas reservoirs. The stimulation fluids are typically comprised of a fluid and chemicals that are mixed at the surface and blended to create viscosity, also known as a gel state. The chemicals include a gelling agent, an activator and a breaker. For many hydrocarbon fluids, the gelling agent is a phosphate ester, the activator is an iron base chemical and the breaker is a basic metal oxide.

The viscous fluid is pumped at high rates downhole and is forced into the hydrocarbon-bearing reservoir under high pressures. When the fluid pressure reaches a level that exceeds the compressive rock pressure, the fluid creates fractures in the rock, and expands existing fractures. The pressurized fluid flows into the fractures. As this is happening, sand or other proppants may be then added to the fluid and pumped downhole to stabilize or prop the fracture open and to provide porosity.

As the fracture stimulation ends, the breaker chemical in the stimulation fluid begins to degrade (or break) the gel, which reduces the viscosity to pre-gel levels. Once the hydrocarbon fluid is broken, the fluid (commonly referred to as 'flow back') is then brought to surface and subsequently sent to oil recyclers for clean-up and reuse.

The extent of the recycling of hydrocarbon stimulation fluids has been limited. Typically the fluid will be stored and reused by simply increasing the concentration of all the chemicals used to create and break the gel. Reuse in this manner can occur only a limited number of times before the hydrocarbon fluid becomes too unstable to create a usable gel system. Lime has also been used to remove residual gels from the stimulation fluid that have not broken. Heating and filtering processes have also been used to treat the hydrocarbon flow back and to remove any solid particles such as sand and clay.

We have previously described a procedure for treatment of a used hydrocarbon stimulation fluid (in co-pending U.S. application Ser. Nos. 11/422,948 and 11/555,149, the contents of which are incorporated herein by reference) entailing treatment with an acid, allowing the activator and breaker chemicals to react to form an aqueous phase and a hydrocarbon phase. The aqueous phase is removed and the hydrocarbon phase is filtered through a settling agent, such as clay or a fine filter to remove the gelling agent. The steps of treatment to remove the activator, breaker and gelling agents may be carried out in any sequence.

Existing recycling processes typically employ a mixing vat and storage tanks, or a number of tanks connected in series. However, the use of multiple tanks can leads to problems with integrity and maintenance as the number of connections increases with the increased number of the tanks used. Also, clean up of an increased number of tanks results in a longer downtime and reduced productivity. Further, as the prior art operations require sequential agitation, settling and filtering steps, the process time for treatment of the fluid is prolonged.

Therefore, there is a need for an apparatus and method for the treatment of stimulation fluid that mitigates the disadvantages of the prior-art.

SUMMARY OF THE INVENTION

The present invention is directed to an apparatus and method for the treatment of stimulation fluid.

In one aspect, the invention comprises a system for the treatment of stimulation fluid, comprising a tank having a first end and second end, and comprising:

(a) a primary agitation section at its first end having a fluid inlet;
(b) a final settling section at its second end, the final settling section having a fluid outlet;
(c) at least one intermediate section disposed between the primary agitation section and the final settling section;
(d) at least one vapour outlet; and
(e) a reagent inlet;

wherein the sections are separated by substantially vertical barriers, and wherein fluid flows from the first end of the tank to the second of the tank by passing from section to adjacent section over the top of the vertical barriers.

In one embodiment, the reagent inlet comprises at least one storage vessel connected to the fluid inlet. In one embodiment, the at least one storage vessel comprises a storage vessel containing an acidic solution and a storage vessel containing liquefied clay. In one embodiment, there is a section outlet in a lower portion of each tank section for the removal of denser substances. In one embodiment, there is an agitation and mixing system connected to the section outlets, the agitation and mixing system also being connected to the fluid inlet whereby the denser substances may be selectively removed from each section and mixed and agitated and then reintroduced to the tank through the fluid inlet. In one embodiment, there is a coupling for a suction truck connected to the section outlets for the selective removal of the denser substances.

In one embodiment, one or more of the sections has a sloped floor sloped in an orientation angled up towards the second end of the tank. In one embodiment, the fluid inlet of the tank is connected to at least one fluid storage vessel and the fluid outlet of the tank is connected to at least one fluid storage vessel. In one embodiment there is a heat exchange system connected to the fluid storage vessels and to the fluid inlet of the tank such that the stimulation fluid may be heated before entry into the tank through the fluid inlet.

In another aspect, the invention comprises a method of treating a stimulation fluid comprising the steps of;

(a) introducing the stimulation fluid into a tank having a first end and a second end and having
  i. a primary agitation section at its first end having a fluid inlet;
  ii. a final settling section at its second end, the final settling section having a fluid outlet;
  iii. at least one intermediate section positioned between the primary agitation section and the final settling section; and
  iv. at least one vapour outlet; and
  v. wherein the sections are separated by substantially vertical barriers, and wherein fluid in the tank flows from the first end of the tank to the second end of the tank by passing from section to adjacent section over the top of the vertical barriers;

(b) introducing reagents to the stimulation fluid as its introduced into the tank through the fluid inlet;

(c) selectively agitating the mixture of stimulation fluid and reagents in one or more of the sections;

(d) selectively removing denser substances from one or more of the sections; and (e) removing hydrocarbon fluid from the fluid outlet of the tank.

In one embodiment the stimulation fluid is heated before introducing it to the tank.

BRIEF DESCRIPTION OF THE FIGURES

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

DETAILED DESCRIPTION

The present invention relates to an apparatus and method for the treatment of stimulation fluid. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

Figure 1:
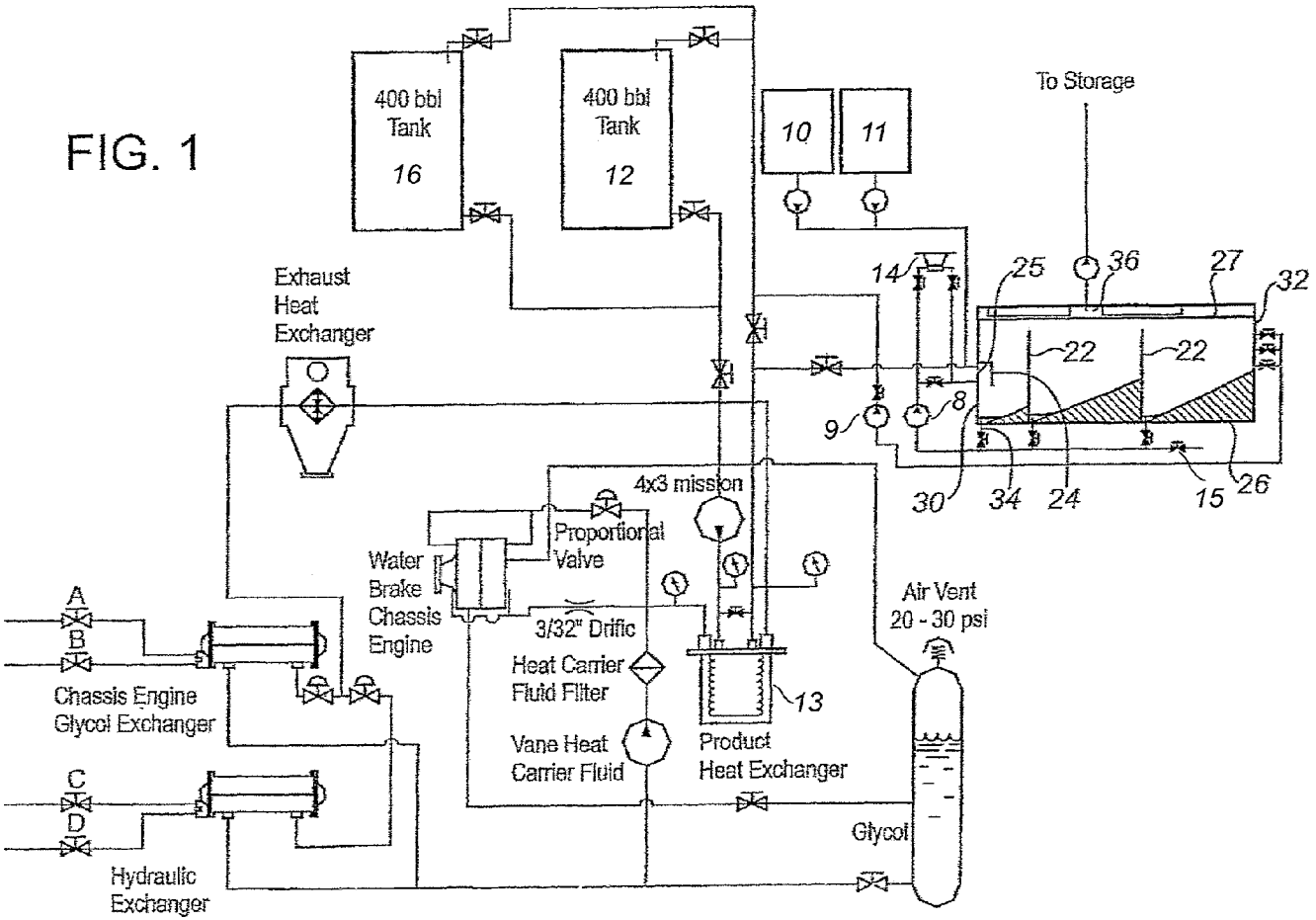
FIG. 1 is a schematic depiction of the elements of one embodiment of the present invention.
Figure 2:
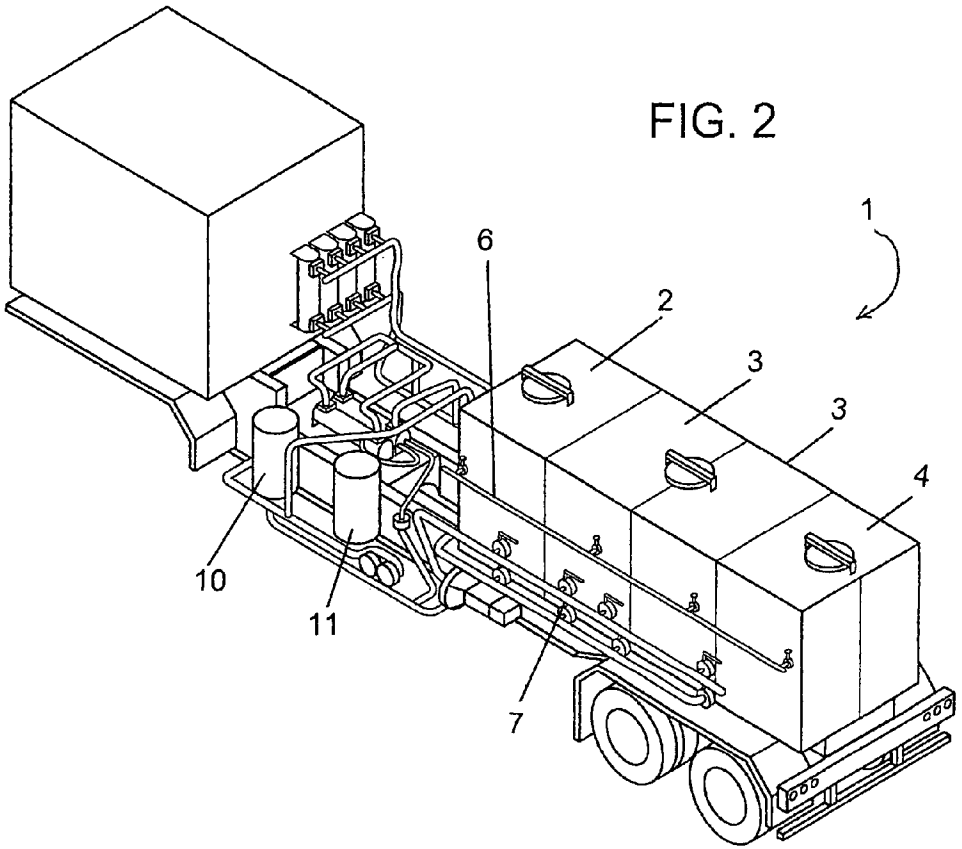
FIG. 2 is a perspective view of one embodiment of the invention on a mobile trailer.
Figure 3:
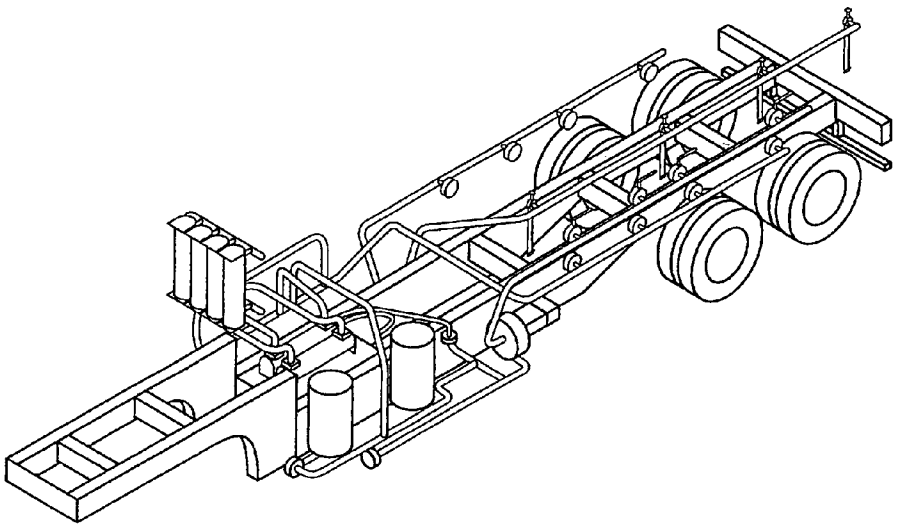
FIG. 3 is a perspective view of the mobile trailer of FIG. 2 with the tank removed.
Figure 4:
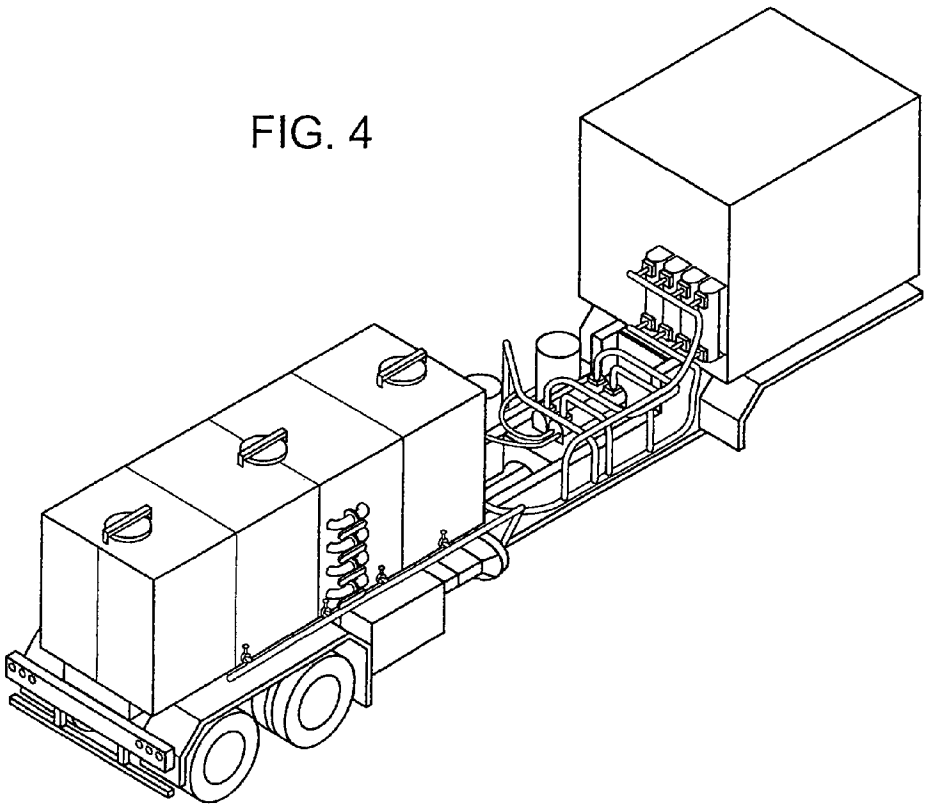
FIG. 4 is a perspective view disclosing the opposing side of the mobile trailer of FIG. 2.
Figure 5:
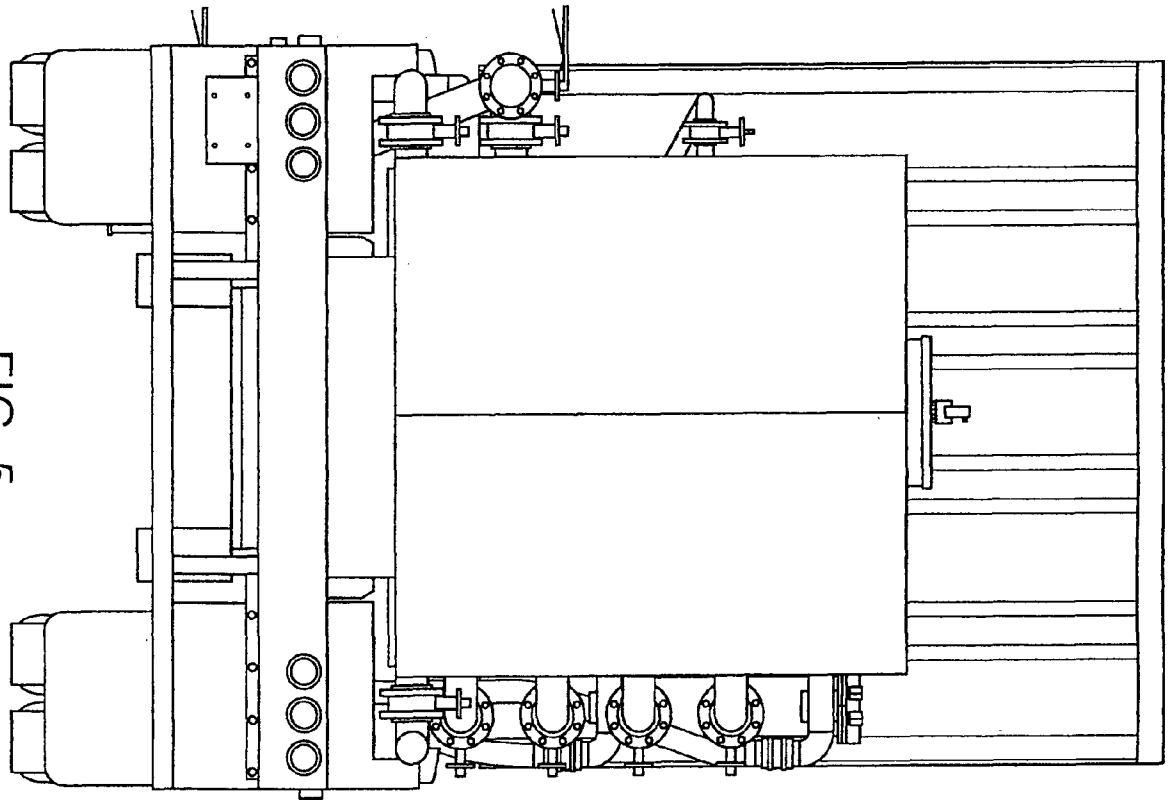
FIG. 5 is an elevational back view of the mobile trailer of FIG. 2.
Figure 6:
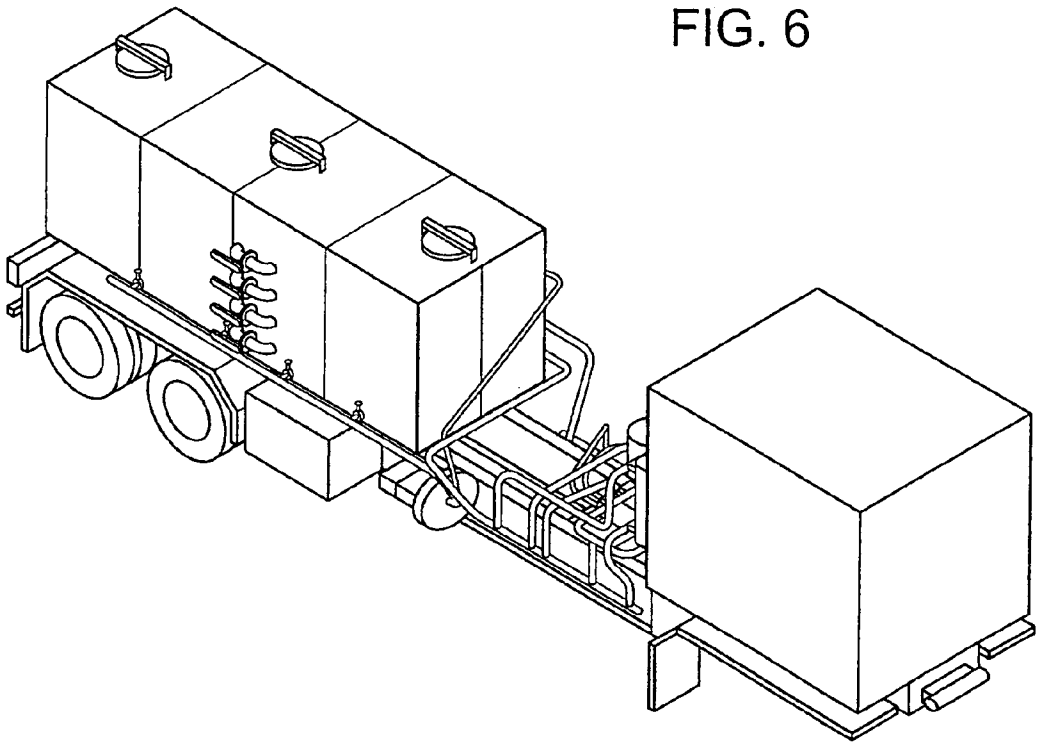
FIG. 6 is another perspective view of the mobile trailer of FIG. 2.

FIG. 1 illustrates a schematic depiction of one embodiment of the present invention. The treatment of the stimulation fluid is carried out in a tank (1) having a first end (30) and a second end (32) and that is sectioned. As shown in FIG. 1, in a preferred embodiment, the tank (1) has three sections, a primary agitation section (2) into which the stimulation fluid is initially charged through the fluid inlet (25), an intermediate settling section (3) and a final settling section (4). However the tank (1) may have any number of intermediate sections to optimize the process as required. The final settling section (4) has a fluid outlet (6) for the removal of treated fluid. The sections are separated by substantially vertical barriers (22) that extend from the floor of the tank (26) upwards towards the roof of the tank (27). The transfer of fluid from one section to another occurs by primarily or solely by flowing over the top of the barriers (22) when the level of the fluid in the section reaches the level of the top of the vertical barrier (22). Solids and denser fluids remain trapped behind the barrier while lighter fluids forming the upper layers pass over the barrier.

As the stimulation fluid is pumped into the tank (1) through the fluid inlet (25), reagents including, but not limited to, liquefied clay and acidified water are added from separate storage vessels (10, 11). The mixture of reagents and stimulation fluid enters the tank through the fluid inlet (25) and fluid flows in a direction from the first end of the tank (30) towards the second end of the tank (32).

As more of the stimulation fluid and reagent mixture is added, any reagent, such as clay or aqueous acid and having a density greater than the density of the stimulation fluid settles to the bottom of each section, while the lighter hydrocarbon-based stimulation fluid forms an upper layer. Some of the heavier density reagent may overflow into the intermediate (3) or final settling section (4); however, the amount settling in the bottom of the sections decreases in going from the primary (2) to the final section (4). The primary agitation section (2) may be provided with a baffle (24) to direct the flow of the mixture of stimulation fluid and reagent mixture downwardly towards the floor of the tank (26). As more of the mixture is added and is agitated by re-circulation (as described below) in the primary agitation section (2), the primary section (2) becomes filled and the stimulation fluid and some reagent and entrained solids may overflow into the adjacent intermediate section (3). Operation in this manner continues until the level of fluid in the intermediate section (3) reaches a level whereby it spills over into the final settling section (4).

As shown in FIG. 1, in one embodiment, the tank further comprises a fluid agitation system that can be coupled to the primary agitation section (2), or to any of the other sections to promote the mixing of the reagents and the stimulation fluid. In this manner, the lower phases of a section may be selectively removed and mixed and agitated and then reintroduced to the primary section (2) through the fluid inlet (25). The system consists of a loop containing a mixing pump (8) and optionally a jet mixer (14) as well. Fluid is extracted from the bottom of the sections through a section outlet (34) positioned at the lowest point of the floor of each section. The extracted fluid is mixed and agitated using the mixing pump (8) and then reintroduced to the tank (1) through the fluid inlet (25). The jet mixer (14) may be additionally used to introduce powdered additives such as clay. Agitation in this manner promotes thorough and complete mixing of the reagents and the stimulation fluid. Agitation in the primary and intermediate sections may also be achieved using such other suitable agitation means as would be selected by one skilled in the art including use of a mechanical agitator (not shown in the Figures) and baffles (not shown in the Figures).

The sections of the tank are connected such that they share a common vapour space towards the roof of the tank (27). The tank (1) has a vapour outlet (36) to facilitate the removal of vapor build up. In one embodiment, a vapour transfer line having an associated pump (5) is coupled to the vapour outlet (36) for the avoidance of pressure build-up. In one embodiment, after the stimulation fluid and regent mixture has been thoroughly mixed for sufficient amount of time in a section, the entire section containing the reagent-fluid mixture may be transferred to the next section, analogous to a batch process, or alternatively, the operation can be carried out as a continuous process, where portions of a section are transferred to the adjacent section and so on.

The intermediate and final settling sections allow for separation of the hydrocarbon phase from the aqueous phase in the case of acid treatment, or separation of the hydrocarbon phase from the settling agent for removal of the gelling agent. Complete separation is not necessarily required and may be monitored by means of a sight-tube (not shown) or the like.

Any of the sections may include a sloping floor to assist in collection and removal of solids, or denser fluids. In one embodiment, each of the sections comprises a floor which slopes upwards towards the second end of the tank (32), as shown in FIG. 1. As already discussed, a section outlet (34) is situated in a lower portion of each section. In one embodiment the section outlet (36) comprises a collection tube placed transversely within each section, at the bottom of the sloping floor. The section outlets (36) may be attached to a suction manifold (7) as described below.

A fluid outlet (6) is connected to the final settling section (4) for removal of the treated stimulation fluid and, transfer and storage to a product return vessel or barrel (16) assisted by a product return pump (9). The sections outlets (36) are also connected to a tank suction manifold (7) via appropriate valves. At one end, the tank suction manifold (7) is connected to a suction point for a vacuum truck (15) that may be used to clean out the unit when operations has been completed or to change chemicals during operation, and at the other end to the previously described agitation and mixing system. The tank suction manifold (7) allows for recirculation of the stimulation fluid and more complete treatment of the fluid, which may be tested using appropriate sensors within each section.

In one embodiment, the primary agitation section (2) has a volume approximately one-half of the intermediate settling section (3) and a final settling section (4), which may have approximately equal volume. Relative residence time in each section may be manipulated by providing different volume capacity in each section, or by varying the height of the barriers (22) which separate the sections, or both. Overall residence time in the tank (1) may be varied by altering the flow rate into the fluid inlet (25).

FIG. 1 also discloses a heat exchange system (13) with appropriate connections, valves, pumps and controls connected to two fluid storage vessels (12 and 16). The fluid storage vessels (12 and 16) may be used to store untreated stimulation fluid and to receive treated fluid from the fluid outlet (6). The heat exchange system (13) is used to preheat the stimulation fluid prior to introduction to the tank (1) which promotes reactivity with the reagents. Various modifications can be made to the heat exchange system without departing from the scope of the invention. In addition, although glycol has been indicated as the fluid for heat exchange, a skilled artisan would recognize that other fluids have heat exchange capacity, such as, for example, Thermaoil™, Dowtherm™ or Silitherm™ can also be used, where appropriate.

The setup disclosed in FIG. 1 has a common pathway, which is preferred but not essential, for the two fluid storage vessels (12, 16) for receiving and heating the fluid. The outlet from the heat exchanger is set up so that the product may be returned to the originating vessel or can be used to transfer the fluid from one product vessel to another. In addition, appropriate connections and valves have been provided to re-direct the stimulation fluid from either storage vessel (12, 16) for treatment to the inlet on the tank (1).

The size of the apparatus for treatment of the fluid can vary depending upon the objective for use of it, as would be known to a skilled artisan. In addition, the apparatus can be setup near a site of operation or can be mounted and operated on a moving vehicle, as shown in FIGS. 2-6, or may be skid-mounted. FIGS. 2-6 disclose an embodiment with additional intermediate settling sections, which may be added as required, for optimization of the process.

Various other modifications and amendments may be made to the apparatus disclosed and discussed herein, without departing from the scope of the invention, as defined by the appended Claims.

The invention claimed is:

1. A tank for the treatment of stimulation fluid, the tank having a first end and second end and the tank comprising:

(a) a primary agitation section at its first end having a fluid inlet;

(b) a final settling section at its second end, the final settling section having a fluid outlet;

(c) at least one intermediate section disposed between the primary agitation section and the final settling section;

(d) each of the primary agitation section, the at least one intermediate section and the final settling section having a section outlet in a lower portion of the section for the removal of denser substances;

(e) an agitation and mixing system connected to at least one of the section outlets, the agitation and mixing system also being connected to the fluid inlet whereby the denser substances may be selectively removed from at least one section and mixed and agitated and then reintroduced to the tank through the fluid inlet;

(f) at least one vapour outlet; and (g) means for the introduction of reagents;

wherein the sections are separated by substantially vertical barriers, and wherein fluid flows from the first end of the tank to the second of the tank by passing from section to adjacent section over the top of the vertical barriers.

2. The tank of claim 1 wherein the means for the introduction of reagents comprises at least one storage vessel connected to the fluid inlet.

3. The tank of claim 2 wherein the at least one storage vessel comprises a storage vessel containing an acidic solution and a storage vessel containing liquefied clay.

4. The tank of claim 1 further comprising a coupling for a suction truck connected to the section outlets for the selective removal of the denser substances.

5. The tank of claim 1 wherein one or more of the sections has a sloped floor sloped in an orientation angled up towards the second end of the tank.

6. The tank of claim 1 wherein the fluid inlet of the tank is connected to at least one fluid storage vessel and wherein the fluid outlet of the tank is connected to at least one fluid storage vessel.

7. The tank of claim 6 further comprising a heat exchange system connected to the fluid storage vessels and to the fluid inlet of the tank whereby the stimulation fluid may be heated before entry into the tank through the fluid inlet.

8. The system of claim 1 wherein at least the tank is vehicle-mounted or skid-mounted.

9. The tank of claim 5 wherein the section outlet in the sections having a sloped floor comprises a collection tube transversely disposed at the foot of the slope.

10. The tank of claim 1 wherein the agitation and mixing system comprises a mixing pump connected to at least one of the section outlets and connected to the fluid inlet.

11. The tank of claim 9 wherein the agitation and mixing system further comprises a jet mixer for adding powdered additives to the denser substances, the jet mixer being connected to the mixing pump and the fluid inlet.

* * * * *